United States Patent [19]

Birx et al.

[11] Patent Number: 4,928,020

[45] Date of Patent: May 22, 1990

[54] SATURABLE INDUCTOR AND TRANSFORMER STRUCTURES FOR MAGNETIC PULSE COMPRESSION

[75] Inventors: Daniel L. Birx, Londonderry, N.H.; Louis L. Reginato, Orinda, Calif.

[73] Assignee: The United States of America as represented by the United States Department of Energy, Washington, D.C.

[21] Appl. No.: 178,041

[22] Filed: Apr. 5, 1988

[51] Int. Cl.[5] ..... H05H 5/08

[52] U.S. Cl. ..... 307/106; 307/107; 307/415; 307/416; 336/212; 336/213; 336/229; 336/5; 328/65; 328/233; 328/67

[58] Field of Search ..... 307/105–109, 307/410, 411, 412, 415, 419, 264, 265, 268, 314; 328/65, 67, 227, 233; 336/5, 160, 212, 213, 205, 218, 219, 222, 229, 233; 323/56, 249, 250, 263, 329, 331, 334, 335, 336, 344, 319, 301; 363/14, 17, 24, 26, 43, 50, 59, 75, 82, 90, 172; 331/166; 333/20

[56] References Cited

U.S. PATENT DOCUMENTS

| | | | |
|---|---|---|---|
| 2,408,824 | 10/1946 | Varela | 307/108 |
| 2,446,838 | 8/1948 | Lawrence, Jr. | 328/67 X |
| 2,709,791 | 5/1955 | Anderson et al. | 336/229 X |
| 3,435,431 | 3/1969 | Heckler et al. | 307/106 |
| 3,711,725 | 1/1973 | Johannessen | 307/107 X |
| 3,786,334 | 1/1974 | Johannessen | 307/107 X |
| 4,274,134 | 6/1981 | Johannessen | 307/106 X |
| 4,275,317 | 6/1981 | Laudenslager et al. | 307/415 |
| 4,338,657 | 7/1982 | Lisin et al. | 336/5 X |
| 4,558,297 | 12/1985 | Shigeta et al. | 336/213 |
| 4,646,027 | 2/1987 | Birx et al. | 328/233 |
| 4,684,820 | 8/1987 | Valencia | 328/65 X |
| 4,689,592 | 8/1987 | Walker | 336/212 X |
| 4,707,619 | 11/1987 | Chu et al. | 307/106 |
| 4,730,166 | 3/1988 | Birx et al. | 328/233 |

OTHER PUBLICATIONS

"The Application of Magnetic Pulse Compression to the Grid System of the ETA/ATA Accelerator", by Brix et al., Nov. 24, 1982, (UCRL-87265).

"A Multipurpose 5-MeV Linear Induction Accelerator", by Brix et al., Jun. 11, 1984, (UCRL-90554).

"The Use of Magnetic Compression Based on Amorphous Alloys as Drive for Induction Linacs", by Birx et al., Jun. 11, 1984, (UCRL-90788).

"The Use of Induction Linacs With Nonlinear Magnetic Drive as High Average Power Accelerators", by Birx et al., Aug. 20, 1984, (UCRL-90898).

"A Look at Energy Compression as an Assist for High Power RF Production", by Birx et al., Aug. 9, 1984, (UCRL-91598).

"Technology of Magnetically Driven Accelerators", by Birx et al., Mar. 26, 1985, (UCRL-91436).

"Technology Development for High Power Induction Accelerators", by Birx et al., Jun. 11, 1985, (UCRL-92705).

"A Collection of Thoughts on the Optimization of Magnetically Driven Induction Linacs of the Purpose of Radiation Processing", by Birx et al., Apr. 3, 1985, (UCRL-92828).

"The High Brightness Test Stand", by Birx et al., Aug. 7, 1985, (UCRL-93174).

"Induction Linear Accelerator Technology for SDIO Applications", by Birx et al., Nov. 1986, (UCRL-95317).

"Induction Linac-Based FELs", by Birx et al., Mar. 1987, (UCRL-95337).

"Pulsed High Power Beams", By Birx, Jun. 1988. (UCRL-98553).

"The Use of Induction Linacs with Nonlinear Magnetic Drive as High Average Power Accelerators", by Birx et al., (1985).

"Energy and Technology Review", by Lawrence Livermore, National Laboratory, Aug. 1983.

*Primary Examiner*—William M. Shoop, Jr.
*Assistant Examiner*—Paul Ip
*Attorney, Agent, or Firm*—Michael B. K. Lee; Clifton E. Clouse; Judson R. Hightower

[57] ABSTRACT

Saturable inductor and transformer for magnetic compression of an electronic pulse, using a continuous electrical conductor looped several times around a tightly packed core of saturable inductor material.

19 Claims, 10 Drawing Sheets

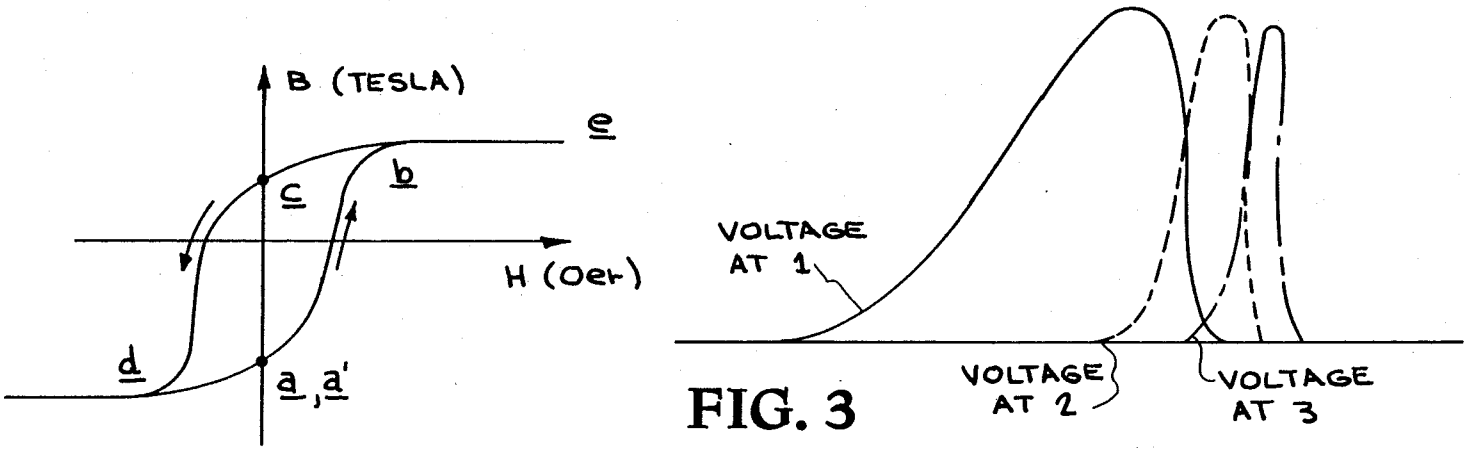
FIG. 3
FIG. 1
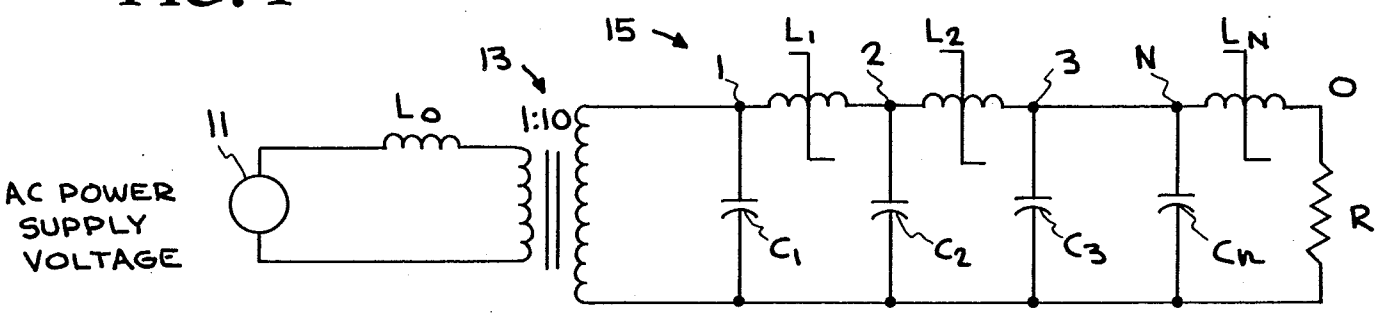
FIG. 2

SATURABLE INDUCTOR AND TRANSFORMER STRUCTURES FOR MAGNETIC PULSE COMPRESSION

FIELD OF THE INVENTION

This invention relates to induction apparatus for temporal compression of electrical pulse signals for driving linear induction accelerators and other suitable electrical loads.

The U.S. Government has rights to this invention pursuant to Contract No. W-7405-ENG-48 between the U.S. Department of Energy and the University of California, for the operation of Lawrence Livermore National Laboratory.

BACKGROUND OF THE INVENTION

A saturable inductor, together with a shunt capacitor, may be used to dramatically reduce the width of a voltage or current pulse, as was observed by Peterson in 1946, by Melville in 1950, by Williams in 1954, and by other early workers in the field. For certain applications, other desirable features of such a voltage or current pulse or train of pulses include: (1) reduction of pulse rise time and fall time to a small fraction of the overall pulse width (e.g., ten percent or less); (2) production of high energy pulses (e.g., 0.1–10 MeV); and (3) provision of pulse repetition frequencies up to ten kilohertz. The subject invention provides saturable reactor and transformer apparatus that manifests these features.

SUMMARY OF THE INVENTION

One object of the invention is to provide apparatus for controllably shortening the temporal width of an electrical pulse signal.

Another object is to provide lumped element inductors and capacitors, transmission line apparatus, and distributed circuit elements for providing a squared pulse with associated electrical efficiency of the order of 90 percent or higher.

Another object is to provide drive apparatus for one or more induction cells that are included in a linear induction accelerator.

Another object is to provide a method for winding each stage of a pulse compression reactor so that the reactor has minimal (saturated) leakage inductance.

Other objects of the invention, and advantages thereof, will become clear by reference to the description herein and the accompanying drawings.

To attain the objects of the invention in accordance with the invention, the invention in one embodiment may comprise: one or more core assemblies, each core assembly comprising a mandrel of mechanically rigid and conducting material and an annular body of ferromaqnetic or ferrimagnetic material contiguous with and surrounding the mandrel, which are coaxially aligned with a hole in the mandrel along the axis; an electrical conductor, having at least two ends and being arranged to make one or more substantially complete turns around each core assembly, the conductor being positioned adjacent to the core assemblies so that the separation of conductor and core assembly annular body minimizes inductance leakage without arcing, the conductor comprising, an upper plate and a lower plate both electrically connected to the mandrels, and outer rods which are electrically connected to the lower plate; signal input means and output means, electrically connected to a first end and a second end, respectively, of the conductor to introduce a pulse into, or to receive such pulse from, the conductor; cooling fluid input and output means operatively associated with each core assembly, to introduce a cooling fluid into a region adjacent to each core assembly and to allow the cooling fluid to exit from a region adjacent to the core assembly; and a source of cooling fluid adjacent to the cooling fluid input means.

In another embodiment, the invention provides an apparatus for moving the present magnetic field operating point of a saturable inductor, having at least two ends and having an associated curve of magnetic flux versus magnetic field strength, to a predetermined initial operating point on the curve, the apparatus comprising: a first current source and a first linear inductor connected in series with a first end of the saturable inductor, with the first linear inductor being connected between the first current source and the saturable inductor; and a second current source and a second linear inductor connected in series with a second end of the saturable inductor, with the second linear inductor being connected between the second current source and the saturable inductor.

BRIEF DESCRIPTION OF THE DRAWINGS

FIG. 1 is a graphic view of the development of magnetic induction, B, in a ferromagnetic or ferrimagnetic material as a function of the magnetic intensity, H, upon which magnetic pulse compression relies;

FIG. 2 shows a magnetic pulse compression circuit previously studied by other technical workers;

FIG. 3 is a graphic view of the contemplated development of a voltage pulse, as a function of time, as the pulse passes through successive nonlinear or saturable inductors in the ladder circuit of FIG. 2;

Figure 4:
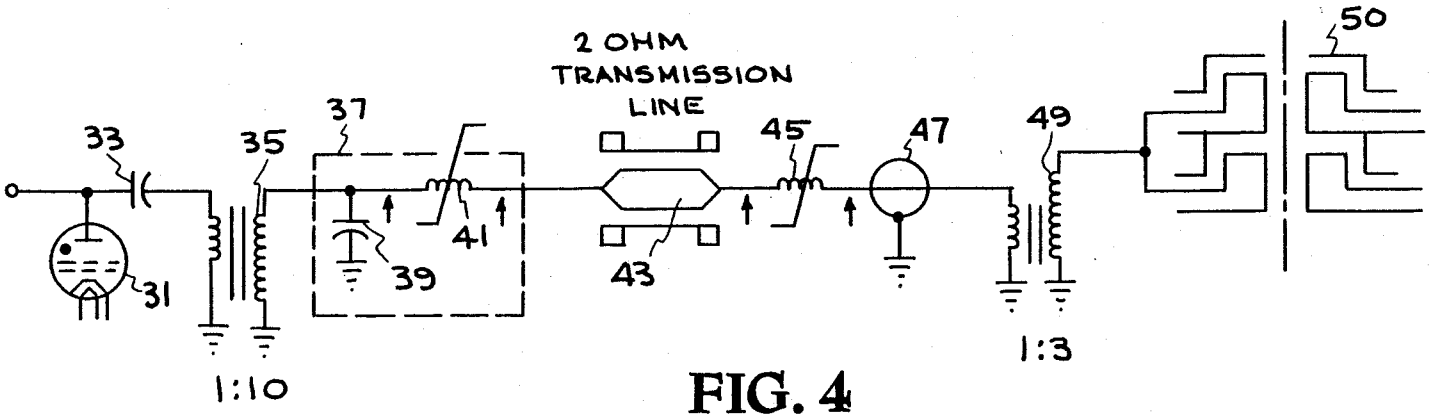
FIGS. 4 and 5 are schematic views of two pulse forming networks, which utilize embodiments of the invention, suitable for producing short voltage or current pulses with the above-mentioned desirable features.

DESCRIPTION OF THE PREFERRED EMBODIMENT:

In one embodiment, the subject invention is a saturable inductor for pulse compression of an electrical signal, allowing a pulse compression ratio of up to 20:1 for a single stage. A saturable reactor uses the cooperative action of a discrete capacitor or distributed capacitance with the inventive saturable inductor that is driven to operate in the high field region where the saturated inductance L(sat) is reduced by a factor of 10-1,000 relative to its unsaturated value extant at low fields. This precipitous fall in inductance is due in large measure to the nonlinear behavior of magnetic induction or flux, B, as a function of magnetic field strength or intensity, H, for very high strengths (several kilo-oersteds) in a ferromagnetic or ferrimagnetic material.

With reference to FIG. 1, showing schematically the development of magnetic induction in a ferromagnetic or ferrimagnetic material as a function of the magnetic intensity, initially the ferro or ferri core is at a point a on the hysteresis curve corresponding to substantially zero magnetic intensity. As the magnetic intensity is rapidly increased, the operating point of the ferromagnetic or ferrimagnetic material moves to point b, approximately at the "knee" of the hysteresis curve, and to e where the permeability approaches unity; after the voltage pulse and corresponding current has passed, the operating point of the ferromagnetic or ferrimagnetic material relaxes from e through c to d and finally back to a new initial point a' after the reset pulse. The points on the operating curve corresponding to initial operating point a and the operating point at the time of the application of the voltage pulse b, are chosen carefully so that the material does not move appreciably beyond the "knee" of the hysteresis curve for a step-up or step-down transformer but moves into region e as a saturable inductor compressing the pulse; this provides maximum efficiency as to the flux swing and corresponding acceleration voltage pulse developed by the ferromagnetic or ferrimagnetic material core.

One pulse-forming network of interest here uses magnetic compression of a pulse in time, by a factor of 10–150, to achieve reproducible, high efficiency (90–95 percent), arbitrary repetition rate voltage pulses of time duration $\geqq$ 1 usec. to drive certain electron beam accelerator modules. FIG. 2 shows a simple magnetic compression ladder network that produces shortened pulses, using the apparatus of Melville. One begins with an ac power supply, 11, coupled to a step-up voltage transformer, 13, across an initial linear inductor $L_0$ to a capacitiveinductive ladder network, 15, comprising a series of substantially identical capacitors $C_1$, $C_2$, ... $C_N$ coupled by saturable inductors $L_1$, $L_2$, ... $L_N$as shown. The ladder network 15 is coupled to ground across a terminal resistor, R, and the saturable inductors of inductance $L_p$, satisfy the relations $$L_p(\text{unsat.})/L_p(\text{sat.}) \geqq f \ (p=1, 2, \ldots N) \text{ and}$$

$$L_p(\text{sat.})/L_{p+1}(\text{sat.}) \geqq g \ (p=1, 2, \ldots N-1),$$

where f and g are predetermined numbers, each greater than or equal to 10. Preferably, f should be $\geqq$ 400 and g should be $\geqq$ 10. As used herein, "capacitive-inductive ladder network" means a network comprising a sequence of N($\geqq$2) capacitors $C_1$, ..., $C_N$ arranged in parallel with each other and with a single resistor, R, at one end, all grounded at a common capacitor terminal, and a sequence of N inductors $L_1$, ..., $L_N$, with inductor $L_n$ (n=1, ..., N−1) coupling the nongrounded terminals of capacitors $C_n$ and $C_{n+1}$ and inductor $L_N$coupling the capacitor $C_N$ and the resistor R.

The ladder network 15 shown in FIG. 2 operates as follows: Capacitor $C_l$ charges through the inductor $L_O$ until the inductor $L_l$ saturates and achieves an inductance much less than that of $L_O$. When this occurs, the capacitor $C_2$ begins to charge from $C_l$ through $L_l^{(sat.)}$; but since the inductance of $L_l^{(sat.)}$ is much less than the inductance of $L_O$, $C_2$ charges much more rapidly than $C_l$ did (faster by a factor of three or more). This process continues through the successive stages until $C_N$ discharges into the load through the inductor $L_N^{(sat.)}$. FIG. 3 indicates the time duration of the successive voltage pulses developed at the network points 1, 2, 3, ..., N indicated in FIG. 2. The apparatus shown in FIG. 2 is useful in explaining the principle of magnetic compression of a pulse, but the preferred embodiment of components of the pulse-forming network used herein is quite different.

To ensure efficiency in this process, saturation at each stage occurs at the peak of the voltage waveform passing that stage. With reference to FIG. 1, segment a-b is the active or high permeability region during which the nonlinear inductor impedes current flow; the leveling off of the hysteresis curve at b and its continuation to e indicates that core saturation has been achieved, and the inductor achieves a very low impedance in this region. During the segment e-c-d-a', the core is reset to its original state for the next cycle.

FIG. 4 exhibits a pulse-forming network that can reduce pulse width from $T_p \approx$ 1–100 μsec. by a factor of 10–50, using as few as two saturable inductors, a capacitor and a pulse transmission line of two ohms (or any other choice of) impedance, which may be water-filled. One or more pulse-sequence-producing devices such as a thyratron 31 (one to eight depending on the energy), having de-ionization or recovery times $T_r \leqq$ twenty μsec. and peak current rating of at least 15 kamps and average current rating of several hundred amperes, produces one or a sequence of pulses of peak voltage substantially 30 kV and temporal duration t=1 μsec. The non-dc component of each such pulse is passed by a first capacitor 33 (C=2.16 microfarads) to a 1:10 transformer 35 that steps the pulse voltage up to substantially 300 kV. The output pulse from the transformer 35 then passes to an energy storage circuit 37, comprising a second capacitor 39 with one terminal grounded (C=20 nfarads) and with a second terminal connected to a first saturable inductor 41 ($L^{(unsat)}$=0.04 mhenrys, $L^{(sat)}$=0.04 μhenrys). The circuit 37 sharpens the output pulse so that rise time is substantially 200 nsec., and the output pulse is further shaped by its passage through a substantially two-ohm impedance pulse transmission line 43, preferably water-filled. The output from 43, is passed through a second saturable inductor 45 ($L^{(unsat)}$=2.0 μhenrys, $L^{(sat)}$=20 nhenrys) and a grounded conducting tube 47 to a second transformer 49 (voltage input:output =1:3), which delivers the voltage pulse(s) to an electrical load 50. At this point, the pulse peak voltage is substantially 450 kV, with rise time and fall time substantially 10–20 nsec. each and FWHM determined by the electrical length of the pulse line 43.

The associated current is substantially 24 kiloamps, which can be used, for example, to drive two 450 kV, 12 kamp induction cells, or a larger or smaller number of cells with correspondingly modified current through each.

Figure 5:
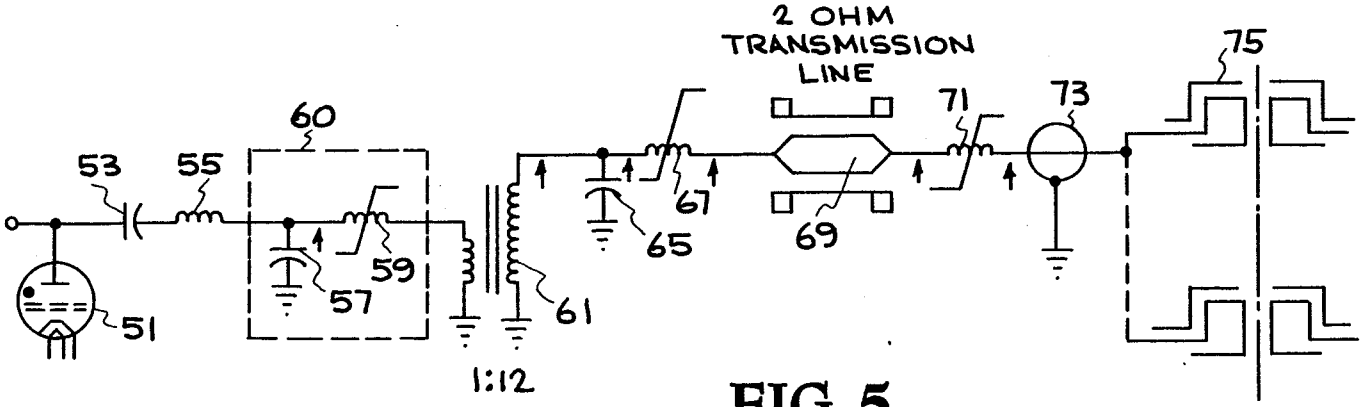

A third approach, shown in FIG. 5, uses three saturable inductors to obtain a similar output. One or more thyratrons 51 each having de-ionization recovery times $T_r \leqq$ twenty μsec. produces one or a sequence of pulses of voltage substantially 25 kV and temporal duration t=five μsec. The pulse(s) is passed across a first capacitor 53 (C=2.16 microfarad) and an inductor 55 (L=2.0 μhenrys) operated in the conventional unsaturated range. The pulse then charges (passes across) the upper terminal of a grounded capacitor 57 (C=2.16 μfarad) and across a first saturable inductor 59 ($L^{(unsat)}$=2.0 μhenry, $L^{(sat)}$=100 nhenry). The capacitor 57 and saturable inductor 59 comprise a first energy storage circuit 60 whose output passes to a 1:12 voltage step-up transformer 61 that steps the pulse voltage (now with rise time substantially 1 μsec.) up to 300 kV. The pulse then passes across the upper terminal of a second grounded capacitor 65 (C=15 nfarads) and across a second nonlinear inductor 67 ($L^{(unsat)}$=0.054 mhenrys, $L^{(sat)}$=0.54 μhenrys). The output pulse from 67, now having rise time of 200 nsec., charges an arbitrary impedance (e.g., two ohms) pulse transmission line 69, preferably water-filled. The output from the line 69 is a pulse of temporal shape proportional to $1-\cos \omega t$, with pulse duration about 200 nsec. This pulse is passed through a third saturable inductor 71 ($L^{(unsat)}$=2.0 μhenrys, $L^{(sat)}$=20 nhenrys) and through a grounded, electrically conducting tube 73 to an electrical load 75 to produce substantially 150 kV voltage and substantially 80 kamp current with a rise time of 10 nsec. and duration ≧20 nsec. (FWHM).

Figure 6A:
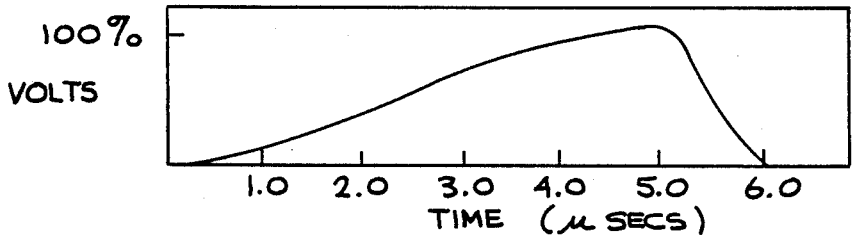
FIGS. 6(A,B,C,D) are graphic views of the voltage pulse shape at four specified positions in the network of FIG. 5.
Figure 6B:
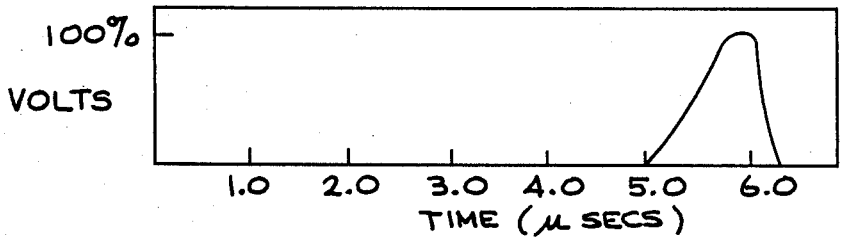
Figure 6C:
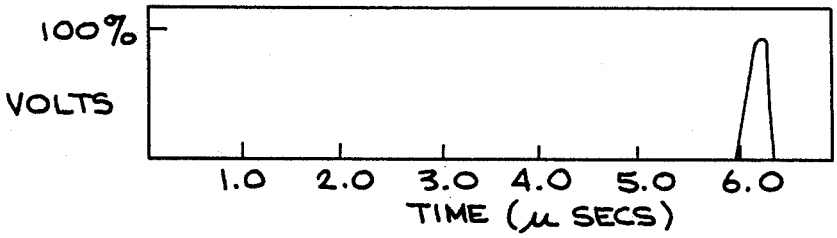
Figure 6D:
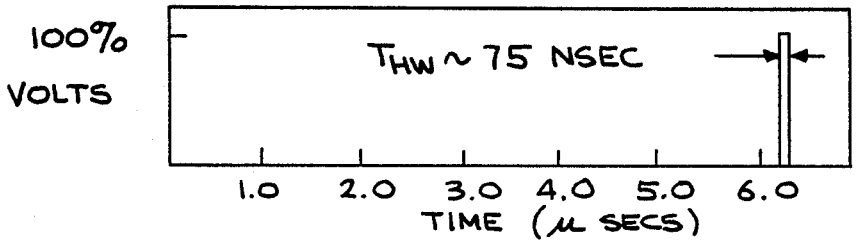

FIGS. 6(A,B,C,D) exhibit shapes of a voltage pulse passing through the pulse shaping/compression network of FIG. 5, as measured at the second capacitor 57 (FIG. 6(A)), the third capacitor 65 (FIG. 6(B)), output of the pulse transmission line 69 (FIG. 6(C)), and the output of the third saturable inductor 71 (FIG. 6(D)), respectively. The initial voltage pulse has FWHM of substantially $T_{HW}$ =5 μsec.; and as this pulse passes through the first, second and third saturable inductors the temporal duration $T_{FWHM}$ is reduced to substantially 0.8 μsec., 300 nsec., and 60 nsec., respectively, with a corresponding reduction in pulse rise time and fall time. For the pulse output after the third saturable inductor 69, the pulse rise time and fall time are each substantially ≧20 nsec.; these rise and fall times can be reduced further, by use of additional saturable inductors, to times of the order of 1-3 nsec. or less. The voltage shapes appearing at the second capacitor 39, the pulse transmission line 43 and the output of the second saturable inductor 45 of FIG. 4 are similar to the shapes shown in FIGS. 6(B), 6(C) and 6(D), respectively.

At some point, the temporal compression may be limited by the amount of charge a circuit element, such as a saturable inductor, can pass in a short time interval without permanently degrading the subsequent performance of the circuit element. This current limitation may be avoided by use of two or more compression networks in parallel, with a corresponding reduction in the maximum current associated with only one network.

In order to improve energy compression at high frequencies and high voltages, it is important that the conductors in a saturable inductor around the magnetic core be wound in such a way as to minimize the leakage flux consistent with maintaining an adequate voltage hold off margin to prevent arcing. That is, the magnetic flux must be contained within a small area by keeping the windings close to the core so that once the magnetic material is saturated (the permeability approaches unity) the leakage or stray inductance is very small, and yet keeping the windings far enough from the core and each other so that as the voltage increases with each winding an arc does not develop between a winding and the core.

Figure 7:
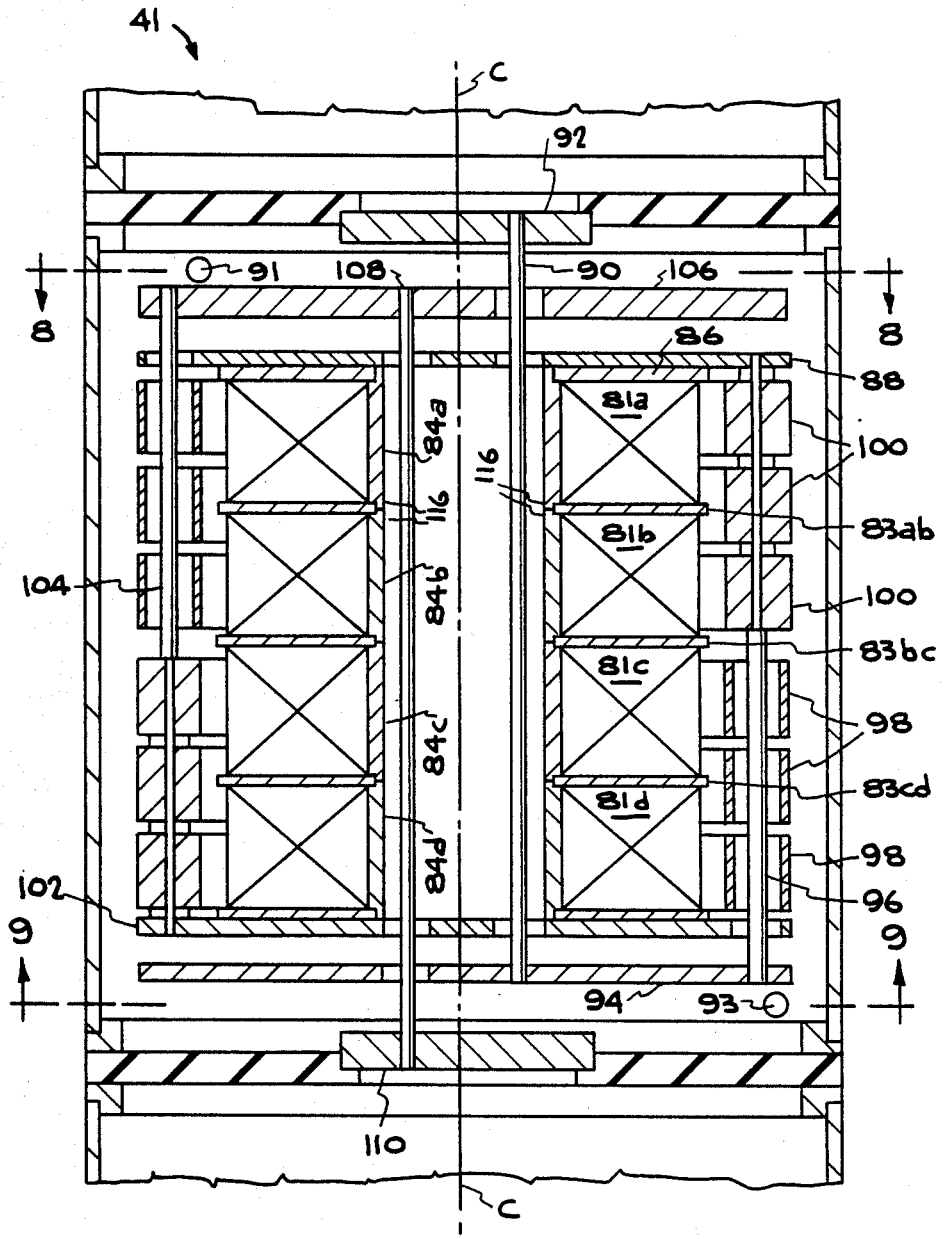
FIG. 7 is a cross-sectional view of one embodiment of the subject invention, a saturable inductor.
Figure 8:
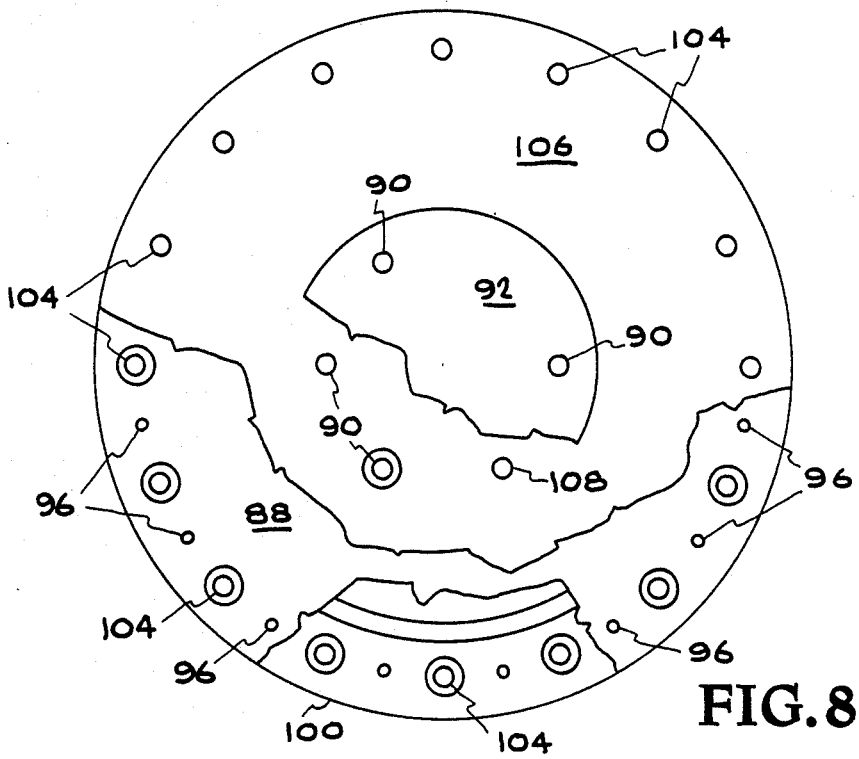
FIG. 8 is top view of the embodiment shown in FIG. 7 along the indicated lines.
Figure 9:
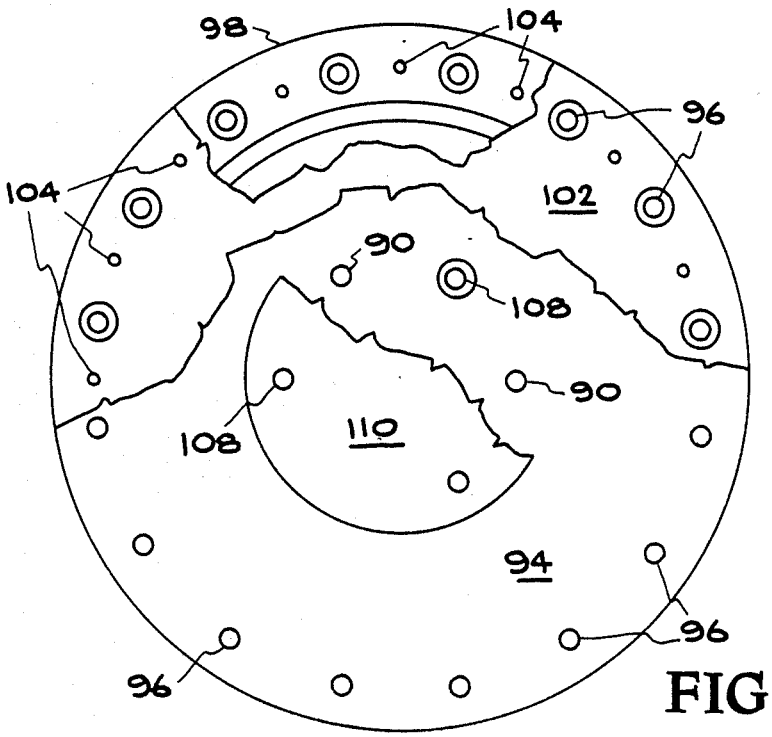
FIG. 9 is a bottom view of the embodiment shown in FIG. 7 along the indicated lines.
Figure 10:
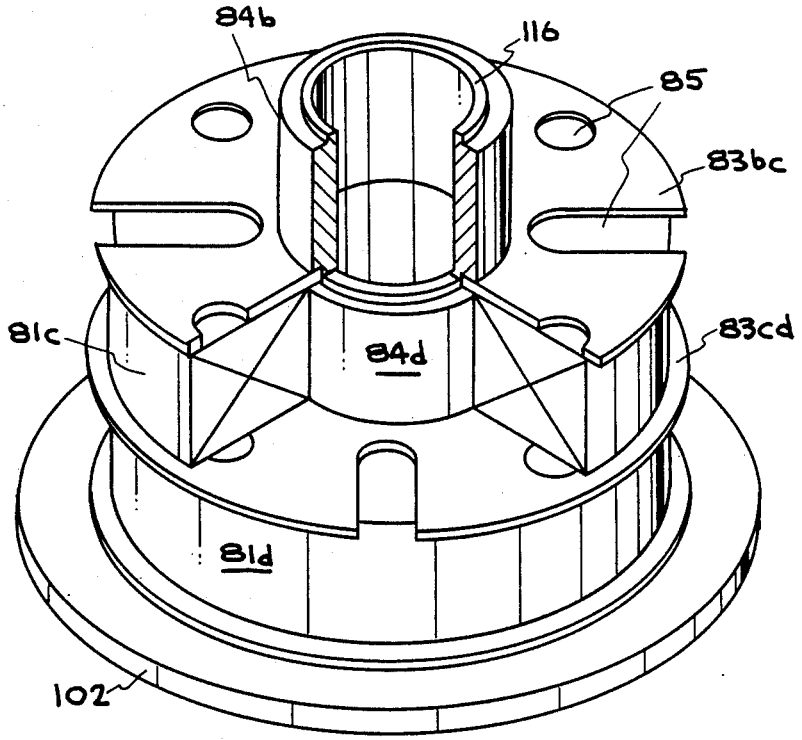
FIG. 10 is a broken away perspective view of the embodiment shown in FIG. 7.

FIG. 7 presents one embodiment of the subject invention for a saturable inductor 41 as shown schematically in FIG. 4, which improves the pulse compression. FIG. 8 is a cut away top view of FIG. 7 as shown. FIG. 9 is a cut away bottom view of FIG. 7 as shown. FIG. 10 is a cut away perspective view of FIG. 7. Two or more substantially identical rings or annular bodies 81*a*, 81*b*, 81*c*, 81*d*, ... of inductor material are coaxially arranged around a common axis C—C so that adjacent faces (side surfaces) of the different rings are substantially planar and substantially contiguous as shown, with the adjacent faces of two adjacent rings (e.g., 81*a* and 81*b*) being separated only by thin insulating plates 83*ab*, 83*bc*, 83*cd*, ... of annular shape but having plate apertures 85 at predetermined positions. These apertures permit a cooling fluid under pressure to move from one ring to an adjacent ring (e.g., from 81*b* to 81*c*) through these apertures and thus to circulate through the collection of rings. A single core or ring 81*a* may be used here, but the power throughput may be limited. Each core of inductor material is wound around a central mandrel 84*a*, 84*b*, 84*c*, and 84*d*. The plates 83*ab*, etc. serve to exclude spillover of magnetic flux from one ring to an adjacent ring on the short time scales (~1 μsec), which is accomplished by preventing eddy current flow in the plates.

In this embodiment the current flows from a grounded capacitor 39 (not shown in this figure but schematically shown in FIG. 4), which is used as an energy storage unit, through a first set of inner conductors 90 which pass through top plate 92. The first set of inner conductors 90 also serve as rods which mechanically hold top plate 92 to a first lower plate 94, which is substantially parallel to the side surfaces of the core assemblies as shown. FIG. 8 shows that 3 identical rods 90 would be used in this embodiment. The inner rods 90 as with all inner rods described in the specification, are substantially parallel to the axis and substantially perpendicular to the side surfaces of the core and pass through the hole in the mandrels. The current would pass through first lower plate 94 to a first set of outer conductors 96. The first set of outer conductors 96 are rods which pass through apertures in lower rings 98 and support upper rings 100, which are substantially coaxial with the core assemblies, and a first upper conducting plate 88, which is on the opposite side of the core assemblies as and substantially parallel to the first lower plate 94 and which is kept from electrical contact with the cores by insulating plate 86, thus mechanically and electrically connecting the first lower plate 94 to the first upper conducting plate 88. Outer rods 96 as with all outer conducting rods in this specification are outside of the core assemblies and substantially parallel to the axis. The current flows through the first upper conducting plate 88 through the mandrels 84*a*, 84*b*, 84*c*, and 84*d* to a second lower conducting plate 102 which is on the same side of the core assemblies as and substantially parallel to the first lower conducting plate. The current flows through the second lower conducting plate 102 through a second set of outer conductors 104, which are rods which support lower rings 98 and pass through apertures in upper rings 100, to a second upper conducting plate 106 which is supported by the rods 104. The current flows through the second upper conducting plate 106 to a second set of inner conductors 108. The current flows through the second set of inner conductors 108 through a bottom plate 110 to the transmission line 43 schematically illustrated in FIG. 4. The second set of inner conductors 108 are rods which mechanically connect the second upper conducting plate 106 to the bottom plate 110 and the transmission line 43.

Figure 11:
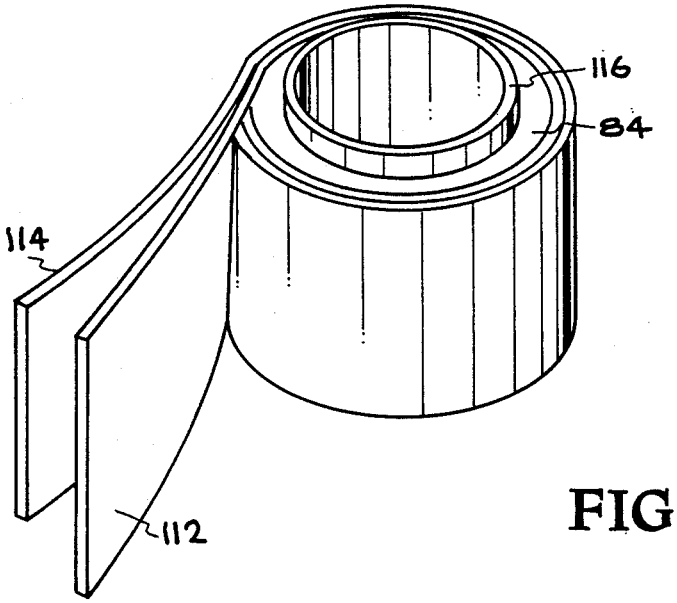
FIG. 11 is a schematic view of a suitable sandwich sheet construction of the metallic glass/insulating material combination used in the core.

Each ring or core of inductor material, for example 81*a*, includes thin layers of a suitable saturable inductor material, such as Allied Metglas 2605SC or other amorphous metallic glass material or other ferromagnetic material such as annealed Fe, Ni or Co, alternating with layers of an electromagnetic insulating material such as mylar or capton. Each of these layers may have thickness a few microns or more. Use of the thinnest metallic glass material available is probably preferable here as this minimizes the eddy current loss associated with currents induced in this material during saturable inductor operation. The alternating layer arrangement may be achieved by wrapping a thin rectangular slab of metallic glass 112 and a thin rectangular slab of insulating material 114 tightly together around a common mandrel 84 as a sandwich sheet of alternating layers, as shown in FIG. 11. For example, the metallic glass and the insulator material sheets might have thicknesses of 15.2 μm and 6.35 μm (0.6 mils and 0.25 mils), respectively. The mandrel material should be mechanically rigid and electrically conducting. In the "cantilever" construction used here, the cores are supported only by the mandrel 84 and the separator plates 83*ab*, etc. so that no space adjacent to the cores is wasted or used inefficiently. The mandrels 84 have a ridge 116 shown in FIGS. 7, 10 and 11 that allow them to interlock with separator plates 83*ab*, ... .

As an alternative to use of the sandwich sheet including metallic glass or other ferromagnetic material, one may use a ferrite material such as ZnNi, MnZn, MnMgZn, MnMgCd, MnMg, MnCu and MnLi, formed as an annular cylinder with a mandrel in the center. Ferrite materials have resistivities that are $10^6$–$10^7$ times as large as those of conventional metals; development of eddy currents in such materials, which would otherwise limit the high frequency performance, is not a serious problem at frequencies up to $10^8$ Hz. Thus, ferrites need not be used only in thin layers for magnetic pulse compression purposes.

This embodiment of the invention provides a compact and durable pulse compressor. The rods that give the invention durability also act as conductors which are placed close to the core to minimize flux leakage and yet spaced to match changes in the impedance thus preventing arcing. In this embodiment the conductor spacing from the core ranges from 0 mm as the current passes through the mandrels in contact with the core, to 50 mm. In addition the electrical compressor is wound like a coaxial transmission line type inductor. The number of turns through which the current passes is kept to a small positive number, in this embodiment 3, to maintain a low impedance. In addition a plurality of parallel windings is used to allow for a large current with low resistance, and minimal flux leakage.

With a core packing factor of the order of 60–70 percent of its maximum and the very low flux leakage of the configuration used here, the electrical efficiency of the saturable reactor is increased from the industry norm of 50–60 percent to 90–95 percent.

In this embodiment a current introduced at one end of the compressor along conductor 90 may have its pulse length reduced by a factor of 10–150, depending upon the core materials used, by the time it reaches the outlet conductor 108.

The transmission line to which outlet conductor 108 leads, in this embodiment, provides an impedance which sharpens the compressed pulse by reducing the rise time and the fall time in a manner similar to the grounded capacitor $C_2$ in FIG. 2.

Figure 15:
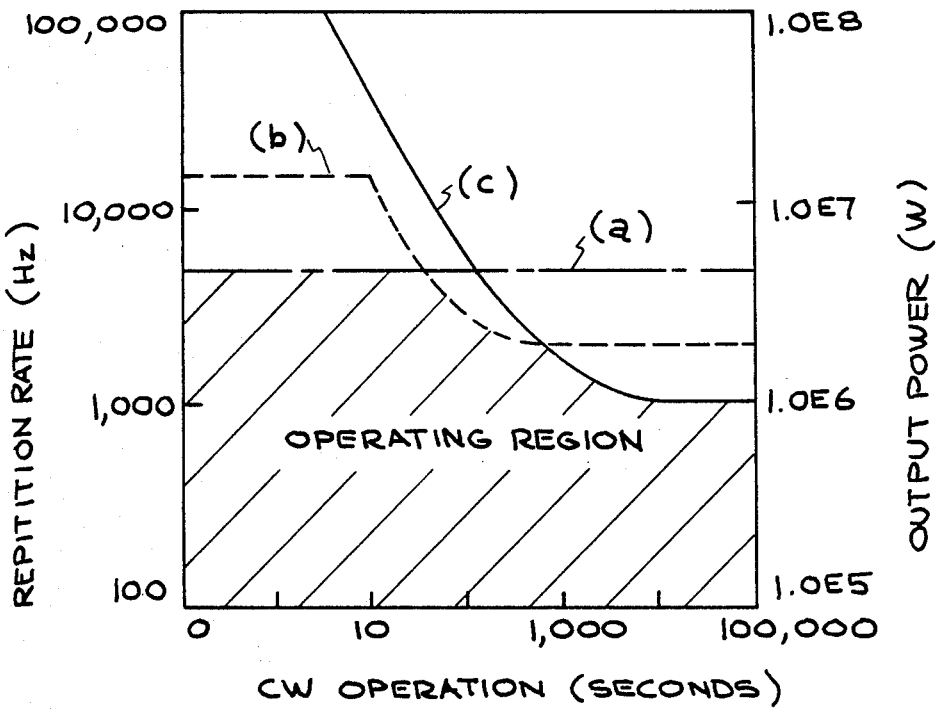
FIG. 15 is a graphic view of permitted repetition rate for a magnetic pulse compression network, as a function of the time interval of operation, where cooling of the saturable inductor apparatus is a limitation.

The core material experiences some power dissipation, and the cooling fluid mentioned above is introduced at a pressures of 1–5 atmospheres into the interior of the apparatus in the housing walls to cool the core material through a fluid inlet 91. It is exhausted through a fluid outlet 93. This allows operation of the reactor at pulse repetition rates up to 10 kHz. and power levels up to several megawatts. Suitable cooling fluids include fluorinert and freon. FIG. 15 indicates the limitations on pulse repetition rate, for a chosen time interval for CW operation, arising from (a) the power supply limit (approximately 5,000 Hz currently), (b) the thyratron commutator or other pulse producer limit, and (c) the thermal limit using freon-cooled critical components.

In the step up or step down transformer it is also imperative that the conductors around the magnetic material be wound in such a way as to minimize the leakage flux consistent with maintaining adequate voltage hold off margin to prevent arcing. This is done by winding the transformer so that as the voltage transformation increases the conductor impedance increases. Since the impedance at the primary is proportional to the square of the ratios of the secondary to the primary number of turns times the impedance of the secondary, the secondary winding must have an increasing spacing in each additional turn. In addition the conductors are wound as a coaxial or parallel transmission line.

Figure 12:
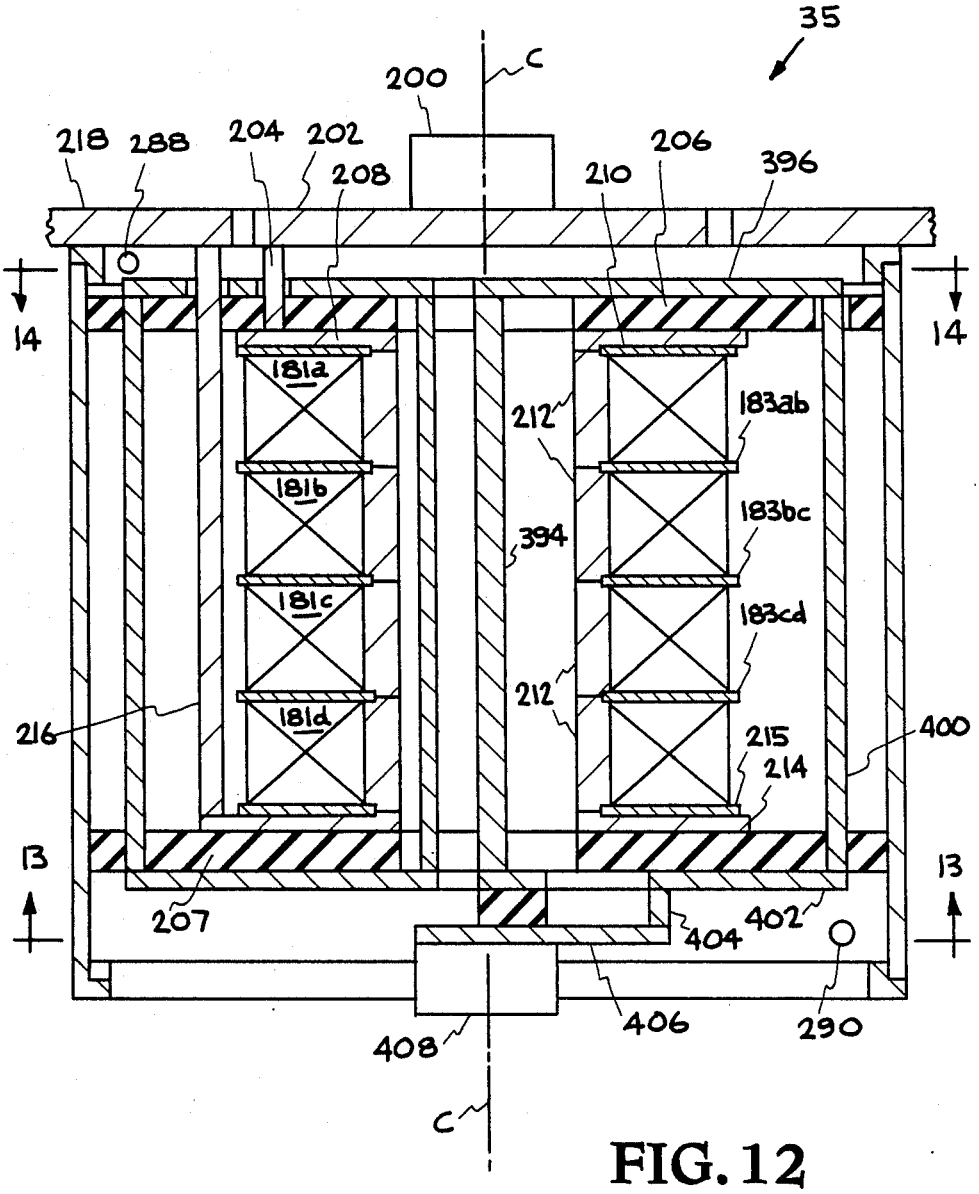
FIG. 12 is a cross-sectional view of a voltage transformer according to the invention.
Figure 14:
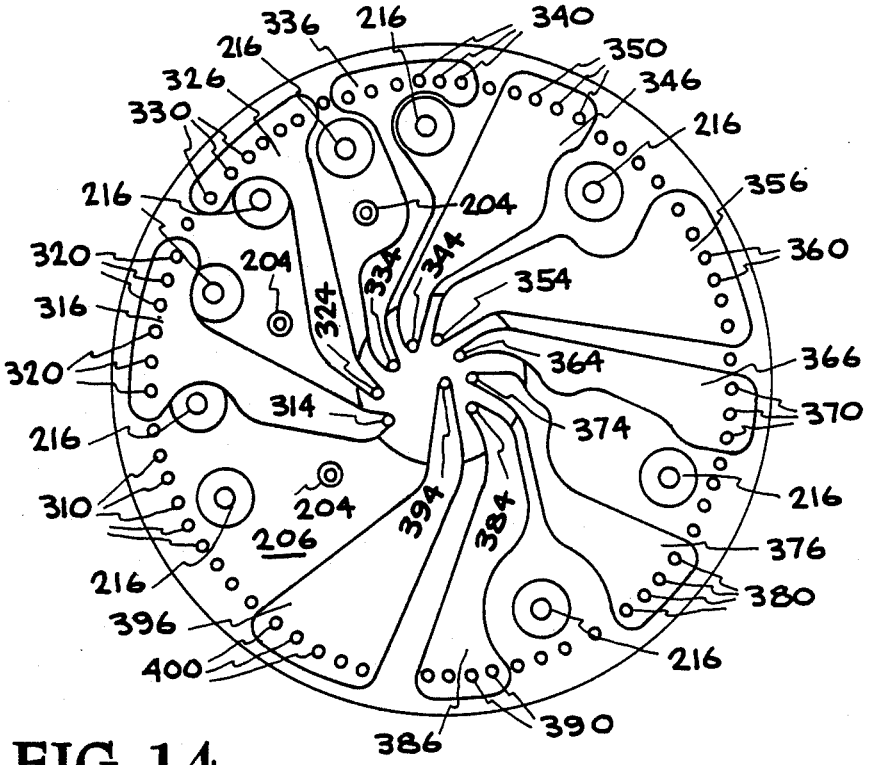
FIG. 14 is a top view of the embodiment shown in FIG. 12 along the indicated lines.
Figure 13:
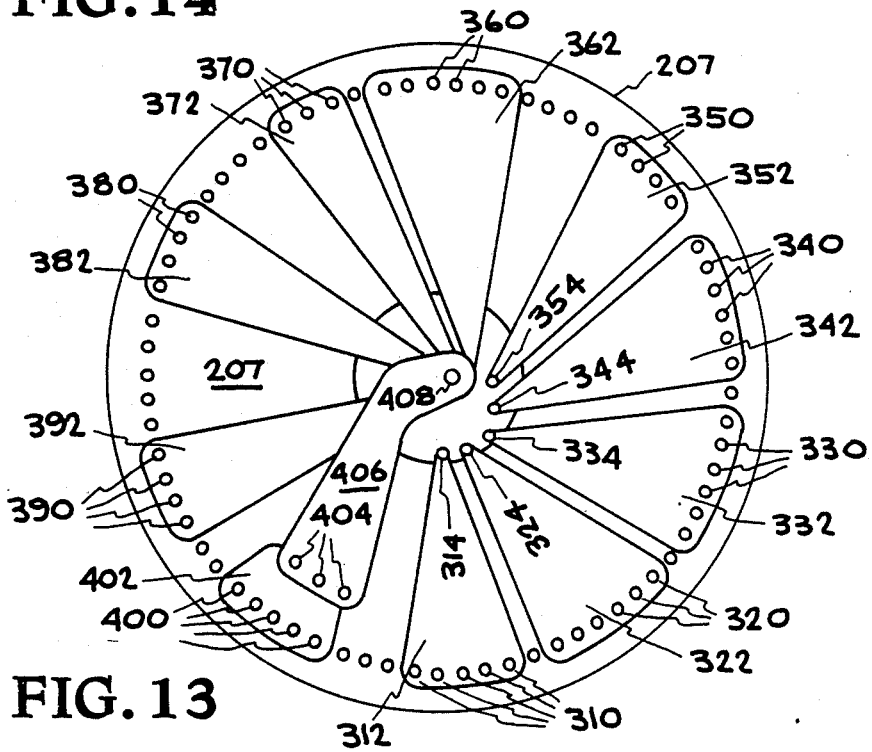
FIG. 13 is a bottom view of the embodiment shown in FIG. 12 along the indicated lines.

FIG. 12 illustrates a cross sectional view of one embodiment of the inventive transformer, which is schematically illustrated in FIG. 4 as transformer 35. It should be noted that each winding in the transformers in FIG. 4 has one end grounded. FIG. 14 shows a top view of the embodiment in FIG. 12 as shown, and FIG. 13 shows the bottom view of the embodiment in FIG. 12 as shown.

The transformer in this embodiment uses two or more substantially identical rings or annular bodies 181*a*, 181*b*, 181*c*, 181*d*, ... of inductor material which are coaxially arranged on mandrels around a common axis C—C with a hole in the mandrels along the axis so that adjacent faces (side surfaces) of the different rings are substantially planar and substantially contiguous as shown, with the adjacent faces of two adjacent rings (e.g., 181*a* and 181*b*) being separated only by a thin insulating plate 183*ab*, 183*bc*, 183*cd*, ... of annular shape but having apertures at predetermined positions. These apertures permit a cooling fluid under pressure to move from one ring to an adjacent ring through these apertures and thus to circulate through the collection of rings. This core assembly may be made exactly like the core assembly described in the previous embodiment for a saturable inductor.

In this embodiment, the voltage to the primary winding is applied at a primary input 200. The current flows from the primary input 200 to a top inner conducting plate 202. The current flows from the top inner conducting plate 202 through one or more conducting rods 204 through an insulator ring 206, to a top conducting ring 208, which is separated from the cores by a top insulating ring 210. The current flows from the top conducting ring 208 through a plurality of mandrels 212 to a lower conducting ring 214, which is separated from the cores by a lower insulating ring 215. Both the top conducting ring 208 and the lower conducting ring 214 are annular plates which are on opposite sides of the core assemblies and are substantially parallel to the side surfaces. The current flows from the lower conducting ring 214 through a plurality of outer primary conducting rods 216, also shown in FIG. 14, to an outer top conducting ring 218, which is grounded, which is schematically illustrated in FIG. 4 for transformer 35.

The top conducting ring 208, the plurality of mandrels 212, the lower conducting ring 214, and the plurality of outer primary rods 216 provide parallel primary current paths which make a single turn. This allows a large current to pass through the primary windings with little resistance and it distributes the winding around the surface of the core while keeping the windings to a single turn.

For the secondary windings in this embodiment a first plurality of secondary outer rods 310 are grounded, which is schematically illustrated for transformer 35 in FIG. 4. It would be obvious that there are many possible ways of grounding these rods 310. One means for grounding these rods 310 is to screw them into the outer top conducting ring 218. The induced current passes through the first plurality of secondary outer rods 310 to a first lower secondary conducting plate 312, which is separated from the primary winding by insulator ring 207. The current flows through first lower secondary conducting plate 312 to a first inner secondary rod 314, and then to a first upper secondary conducting plate 316. The potential along the first inner secondary rod 314 and first upper secondary conducting plate 316 is approximately equal to the potential in the primary winding, so there is no danger of arcing. This allows rod 314 to be placed near the mandrels, and the first upper secondary conducting plate 316 to be placed near outer primary rods 216. The current flows from the first upper secondary conducting plate 316 to a second plurality of outer secondary rods 320 and then to a second lower secondary plate 322. From the second lower secondary plate 322 the current flows through a second inner secondary rod 324 to a second upper secondary conducting plate 326. The second inner secondary rod 324 and the second upper secondary plate 326 have a potential that is approximately twice the potential of the primary winding. This requires some spacing between the second inner secondary rod 324 and second upper plate 326 and the primary winding to prevent arcing. This spacing is minimized, as shown, to minimize the flux leakage. The spacing, as shown in FIGS. 13 and 14, is provided so that the second upper secondary conducting plate 326 and the second inner secondary conducting rod 324 are spaced from the primary winding a little farther than the first upper secondary conducting plate 316 and the first inner secondary conducting rod 314. The current flows from the second upper secondary conducting plate 326 to a third plurality of outer secondary rods 330 and then to a third lower secondary plate 332. From the third lower secondary plate 332 the current flows through a third inner secondary rod 334 to a third upper secondary conducting plate 336. The third inner secondary rod 334 and the third upper secondary plate 336 have a potential that is approximately three times the potential of the primary winding. This requires some spacing between the third inner secondary rod 334 and third upper plate 336, from the primary winding to prevent arcing and yet this spacing must be minimized to minimize the flux leakage. The spacing, as shown in FIGS. 13 and 14, is provided so that the third upper secondary conducting plate 336 and the third inner secondary conducting rod 334 are spaced from the primary winding a little farther than the second upper secondary conducting plate 326 and the second inner secondary conducting rod 324. The current flows from the third upper secondary conducting plate 336 to a fourth plurality of outer secondary rods 340 and then to a fourth lower secondary plate 342. From the fourth lower secondary plate 342 the current flows through a fourth inner secondary rod 344 to a fourth upper secondary conducting plate 346. The fourth inner secondary rod 344 and the fourth upper secondary plate 346 have a potential that is approximately four times the potential of the primary winding. This requires spacing between the fourth inner secondary rod 344 and fourth upper plate 346, from the primary winding to prevent arcing and yet this spacing must be minimized to minimize the flux leakage. The spacing, as shown, is provided so that the fourth upper secondary conducting plate 346 and the fourth inner secondary conducting rod 344 are spaced from the primary winding a little farther than the third upper secondary conducting plate 336 and the third inner secondary conducting rod 334. The current flows from the fourth upper secondary conducting plate 346 to a fifth plurality of outer secondary rods 350 and then to a fifth lower secondary plate 352. From the fifth lower secondary plate 352 the current flows through a fifth inner secondary rod 354 to a fifth upper secondary conducting plate 356. The fifth inner secondary rod 354 and the fifth upper secondary plate 356 have a potential that is approximately five times the potential of the primary winding. The spacing is provided so that the fifth upper secondary conducting plate 356 and the fifth inner secondary conducting rod 354 are spaced from the primary winding a little farther than the fourth upper secondary conducting plate 346 and the fourth inner secondary conducting rod 344. The current flows from the fifth upper secondary conducting plate 356 to a sixth plurality of outer secondary rods 360 and then to a sixth lower secondary plate 362. From the sixth lower secondary plate 362 the current flows through a sixth inner secondary rod 364 to a sixth upper secondary conducting plate 366. The sixth inner secondary rod 364 and the sixth upper secondary plate 366 have a potential that is approximately six times the potential of the primary winding. The spacing is provided so that the sixth upper secondary conducting plate 366 and the sixth inner secondary conducting rod 364 are spaced from the primary winding a little farther than the fifth upper secondary conducting plate 356 and the fifth inner secondary conducting rod 354. The current flows from the sixth upper secondary conducting plate 366 to a seventh plurality of outer secondary rods 370 and then to a seventh lower secondary plate 372. From the seventh lower secondary plate 372 the current flows through a seventh inner secondary rod 374 to a seventh upper secondary conducting plate 376. The seventh inner secondary rod 374 and the seventh upper secondary plate 376 have a potential that is approximately seven times the potential of the primary winding. The spacing is provided so that the seventh upper secondary conducting plate 376 and the seventh inner secondary conducting rod 374 are spaced from the primary winding a little farther than the sixth upper secondary conducting plate 366 and the sixth inner secondary conducting rod 364. The current flows from the seventh upper secondary conducting plate 376 to an eighth plurality of outer secondary rods 380 and then to a eighth lower secondary plate 382. From the eighth lower secondary plate 382 the current flows through a eighth inner secondary rod 384 to a eighth upper secondary conducting plate 386. The eighth inner secondary rod 384 and the eighth upper secondary plate 386 have a potential that is approximately eight times the potential of the primary winding. The spacing is provided so that the eighth upper secondary conducting plate 386 and the eighth inner secondary conducting rod 384 are spaced from the primary winding a little farther than the seventh upper secondary conducting plate 376 and the seventh inner secondary conducting rod 374. The current flows from the eighth upper secondary conducting plate 386 to a ninth plurality of outer secondary rods 390 and then to a ninth lower secondary plate 392. From the ninth lower secondary plate 392 the current flows through a ninth inner secondary rod 394 to a ninth upper secondary conducting plate 396. The ninth inner secondary rod 394 and the ninth upper secondary plate 396 have a potential that is approximately nine times the potential of the primary winding. The spacing is provided so that the ninth upper secondary conducting plate 396 and the ninth inner secondary conducting rod 394 are spaced from the primary winding a little farther than the eighth upper secondary conducting plate 386 and the eighth inner secondary conducting rod 384. The current flows from the ninth upper secondary conducting plate 396 to a tenth plurality of outer secondary rods 400 and then to a tenth lower secondary plate 402. From the tenth lower secondary plate 402 the current flows through plurality of lower pegs 404 to an eleventh lower secondary conducting plate 406 and then to an output 408 which is electrically connected to the energy storage unit schematically illustrated as a grounded capacitor 39 in FIG. 4.

FIGS. 13 and 14 show that the inner secondary rods 314, 324, 334, 344, 354, 364, 374, 384, and 394 form a spiral as successive inner rods are placed further from the mandrels. This spiral allows the higher voltage inner rods 374, 384, and 394 to be placed far from the lower voltage inner rods 314, 324, and 334.

All of the upper secondary conducting plates are segments which form a segmented and spaced upper conducting plate, which is substantially parallel to and on the same side of the core assemblies as the top conducting ring 208, as shown. All of the lower secondary conducting plates except the eleventh lower secondary conducting plate are segments which form a segmented and spaced lower conducting plate, which is substantially parallel to and on the same side of the core assemblies as the lower conducting ring 214, as shown.

This embodiment of the invention provides a compact and durable pulse compressor. The rods that give the invention durability also act as conductors which are placed close to the core to minimize flux leakage and yet are spaced to match changes in the impedance thus preventing arcing. The transformer is wound like a coaxial transmission line type transformer. The primary windings are kept to single turns which are in parallel and distributed around and adjacent to the core to minimize flux leakage and maintain a low resistance. The secondary winding minimizes the spacing from the core to minimize flux leakage and yet provides proper spacing to prevent arcing.

Figure 16A:
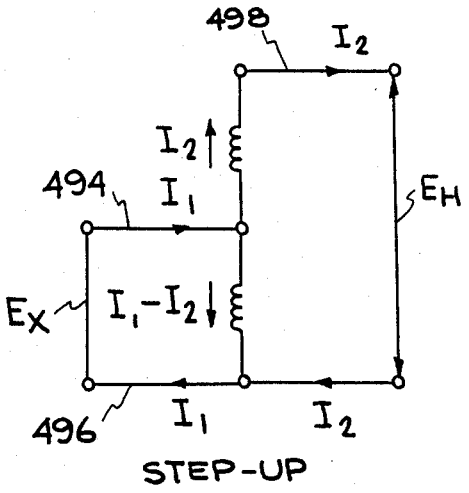
FIGS. 16(A) and (B) show an auto-transformer, useful as an alternative transformer in one embodiment of the invention, for voltage step-up and step-down.
Figure 16B:
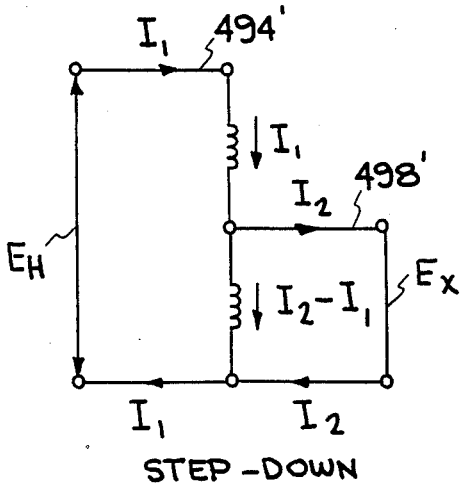

As an alternative to the two conductor paths used for the primary and secondary windings here, one may use a single conductor path, as in an auto-transformer shown schematically in FIG. 16(A) (voltage step-up) and 16(B) (step-down). In FIG. 16(A), current enters through the central segment 494 and proceeds toward both the primary end 496 and the secondary end 498. In FIG. 16(B), primary current enters along segment 494' and secondary current exits along segment 498'. The voltage ratio is $V_{out}/V_{in}=E_H/E_X$ and $E_X/E_H$ respectively.

Cooling fluid, which may be fluorinert, freon or other suitable fluid, may be introduced into the interior of the apparatus in the housing walls to the core assemblies, through a fluid inlet 288 (shown in FIG. 12), and allow the transformer to operate at high repetition rates and high voltages (up to 200 kV for the primary core). The cooling fluid is preferably introduced at pressures of 1–5 bars so that breakdown strength of the vapor will approximate that of the liquid. The cooling fluid is exhausted through a fluid outlet 290. Again, the sandwich sheets that form part of the primary and secondary assemblies should be wound with only modest tightness of fit, to allow a portion of the cooling fluid to circulate between adjacent layers of the sandwich sheet material.

Figure 18:
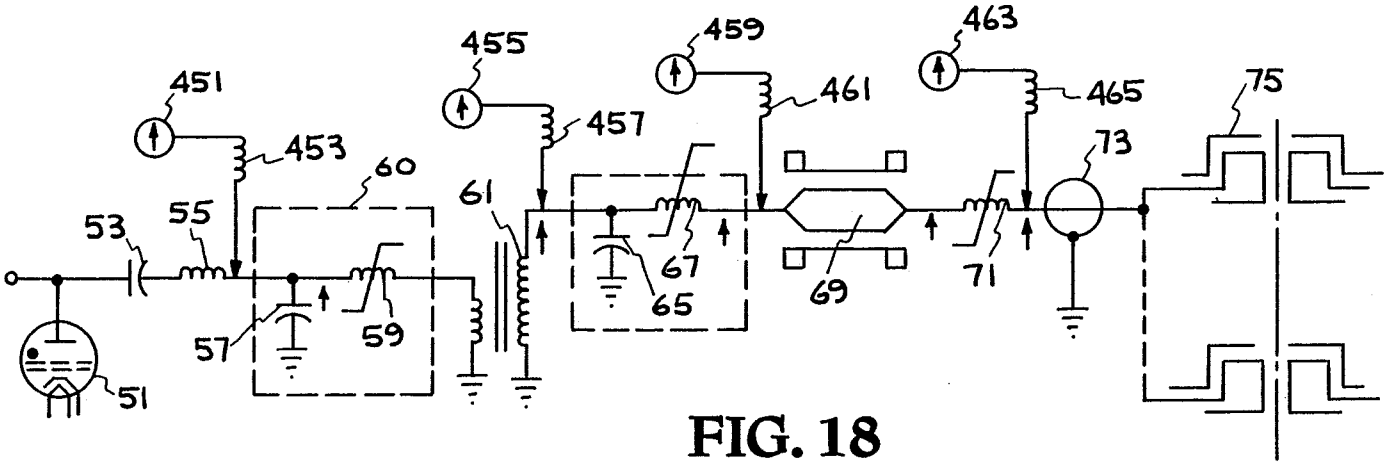

A further feature that adds to the efficiency of operation is a method for resetting the state of the magnetic material whose magnetic characteristics are exhibited in FIG. 1. FIG. 18 is substantially the apparatus of FIG. 5, with a current source 451 and an accompanying inductor 453 positioned between the linear inductor 55 and the first saturable inductor 59, and with a second current source 455 and accompanying inductor 457 positioned between the transformer 61 and the second saturable inductor 67. After the magnetic material of first saturable inductor 59 has reached position e on the curve in FIG. 1, the current source 451 is used to reverse the direction of the magnetic field H in this material and to move the magnetic state of this material from a to b to c to d. The material is now reset to its "initial value" a for another pulse compression cycle by use of the second current source 455 to drive current in the opposite direction (H →0 and state d →state a'). In a similar manner, the current sources 455 and 459 (459 and 463) are used cooperatively to drive the magnetic state of the second (third saturable inductor from e to b to c to d to the "initial state" a'. The placement of the current sources 451 and 455 on opposite sides of the 1:N transformer shown in FIG. 18 takes advantage of the fact that the current on the downstream side of the transformer 61 (source 451) is reduced by a multiplicative factor of 1/N relative to the current on the upstream side of the transformer (source 455). The magnetic field associated with each of the saturable inductors 59, 67 and 71 may be independently varied by use of appropriate strengths for the current sources 451, 455, 459 and 463, to reset the "initial states" of the saturable inductors as desired. Any two current sources positioned on either side of a saturable inductor may be used to reset the initial magnetic state of the inductor.

Figure 17:
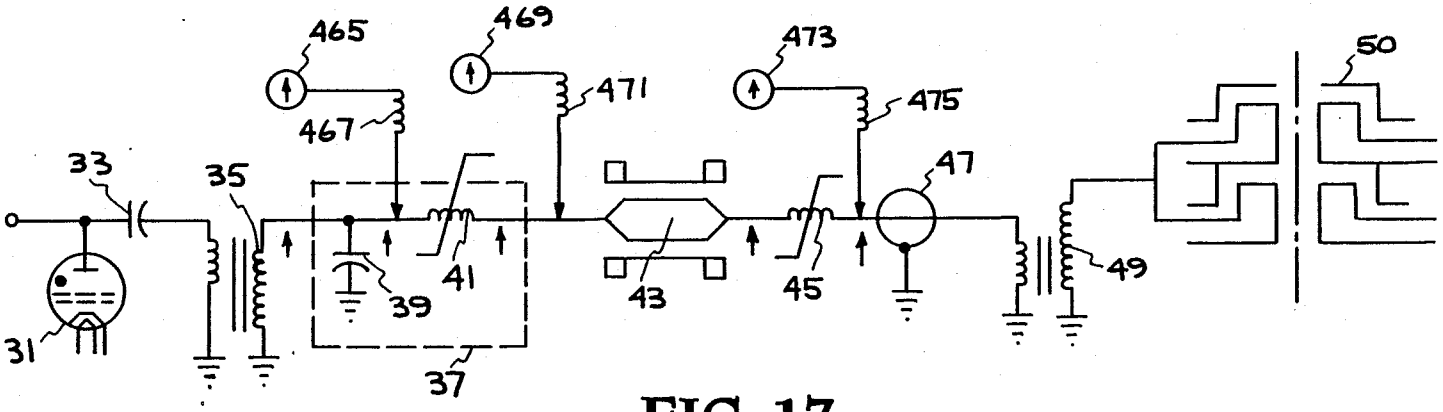
FIGS. 17 and 18 are schematic views of the apparatus of FIGS. 4 and 5 with an inductor reset mechanism included as another inventive embodiment.

In a similar manner, in FIG. 17 current sources 465, 469 and 473, and associated inductors 467, 471 and 475, are placed immediately before the first saturable inductor 41 immediately before the second saturable inductor 45, and immediately after the second saturable inductor 45 in the apparatus shown in FIG. 4 to cooperatively reset the magnetic states of the saturable inductors 41 and 45 and the step-up transformer.

Although the preferred embodiment of the subject invention has been shown and described herein, variation on a modification of the invention may be made without departing from the scope of the invention.

We claim:

1. Electrical transformation apparatus for a magnetic pulse compression circuit, the apparatus comprising:

two or more core assemblies substantially coaxially aligned around a common axis, each core assembly comprising:

a mandrel of mechanically rigid and conducting material with a hole along the axis; and an annular body of ferromagnetic or ferrimagnetic material surrounding and contiguous with the mandrel with side surfaces substantially perpendicular to the axis;

one or more insulating plates, with an insulating plate placed between the side surfaces of two core assemblies;

a first electrical conductor, having at least two ends and forming a plurality of parallel circuits with each circuit arranged to make one or more substantially complete turns around the core assemblies, with the first electrical conductor, comprising:

a first upper conducting plate substantially parallel to the side surfaces of the cores and electrically connected to a mandrel;

a first lower conducting plate substantially parallel to the side surfaces of the cores and electrically connected to a mandrel and wherein the first lower conducting plate and the first upper conducting plate are on opposite sides of the core assemblies; and a first plurality of outer conducting rods distributed around and outside of the core and substantially parallel to the axis, electrically connected to the lower conducting plate;

signal input means, electrically connected to one end of the first electrical conductor, to introduce a voltage pulse or a current pulse into the electrical conductor at that end thereof; and signal output means, electrically connected to a second end of the first electrical conductor, to receive a voltage pulse or a current pulse from the first electrical conductor.

2. Apparatus according to claim 1, wherein said apparatus forms a saturable inductor which comprises a plurality of rings that surround the core assemblies and are substantially coaxial with the core assemblies, wherein the rings are mechanically and electrically connected to some of the outer conductor rods.

3. Apparatus according to claim 2, wherein the first electrical conductor further comprises:

a first plurality of inner conducting rods substantially parallel to the axis and passing through the hole in the mandrels electrically connected to the signal input means;

a second lower conducting plate, on the same side of the core assemblies as and substantially parallel to the first lower conducting plate, mechanically supported by and electrically connected to the first plurality of inner conducting rods;

a second plurality of outer conducting rods distributed around and outside of the core and substantially parallel to the axis, mechanically supporting and electrically connected to the second lower conducting plate;

a second upper conducting plate on the same side of the core assemblies and substantially parallel to the first conducting plate, mechanically supported by and electrically connected to the first plurality of outer conducting rods; and a second plurality of inner conducting rods substantially parallel to the axis and passing through the hole in the mandrels, electrically connected to an mechanically supporting the second upper conducting plate and which are electrically connected to the signal output means; and wherein the second plurality of outer rods electrically connects the second lower plate with the first upper plate and the first plurality of outer conducting rods connects the second upper plate with the first lower plate.

4. Apparatus according to claim 3, further comprising:

cooling fluid input means associated with each core assembly to introduce cooling fluid at a predetermined rate and predetermined pressure adjacent to the core assembly; and cooling fluid output means associated with each core assembly to allow cooling fluid to exit from the region adjacent to each core assembly.

5. Apparatus according to claim 4, wherein said core assembly is made of a ferrimagnetic material chosen from the class consisting of MnZn, ZnNi, MnMg, MnMgZn, MnMgCd, MnCu and MnLi.

6. Apparatus according to claim 4, wherein said core assembly is made of a ferromagnetic material chosen from the class consisting of amorphous metallic glass, and annealed Fe, Ni, and Co; and the ferromagnetic material is in the form of a sheet less than 25 um thick wrapped around the mandrel in an alternating layer arrangement with a thin sheet of an insulator.

7. Apparatus according to claim 6, wherein said cooling fluid is chosen from the class consisting of fluorinert and freon.

8. Apparatus according to claim 1, wherein said apparatus forms a voltage or current auto-transformer apparatus and said electrical conductor makes a substantially complete turn around each core assembly.

9. Apparatus according to claim 1, wherein said apparatus forms a voltage or current transformer apparatus, further comprising, a second electrical conductor arranged to make two or more substantially complete turns around said core assembly, with the second electrical conductor being positioned adjacent to said core assembly.

10. Apparatus according to claim 9, wherein the first electrical conductor forms a plurality of parallel circuits with each circuit arranged to make one substantially complete turn around the core assembly.

11. Apparatus according to claim 10, wherein the second electrical conductor further comprises:

a segmented lower plate on the same side of the core assemblies and substantially parallel to the first lower conducting plate, comprising a plurality of lower segments;

a plurality of inner rods, which are substantially parallel to the axis and pass through the hole in the mandrels, having a first end and a second end, with each inner rod electronically connected to a lower segment at their first end;

a plurality of secondary outer rods, distributed outside of the core assemblies and substantially parallel to the axis, having a first end and a second end, wherein each lower segment is electronically connected to at least one secondary outer rod at the outer rod's first end; and a segmented upper plate on the same side of the core assemblies and substantially parallel to the first upper conducting plate, comprising a plurality of upper segments, wherein each upper segment is electronically connected to at least one secondary outer rod at the rod's second end and one inner rod at the inner rod's second end.

12. Apparatus according to claim 11, wherein:

a first plurality of secondary outer rods is grounded at their second ends;

a first lower segment is electrically connected to the first plurality of secondary outer rods at their first ends;

a first inner rod is electrically connected to the first lower segment at the inner rod's first end;

a first upper segment is electrically connected to the second end of the first inner rod;

a second plurality of secondary outer rods are electrically connected to the first upper segment at their second ends;

a second lower segment is electrically connected to the second plurality of secondary outer rods at their first ends;

a second inner rod is electrically connected to the second lower segment at the inner rod's first end;

a second upper segment is electrically connected to the second end of the second inner rod;

a third plurality of secondary outer rods are electrically connected to the second upper segment at their second end; and a third lower segment is electrically connected to the third plurality of secondary outer rods at their first end.

13. Apparatus according to claim 12, wherein:

the second electrical conductor makes at least five substantially complete turns around the core assembly;

a third inner rod is electrically connected to the third lower segment at the inner rod's first end;

a third upper segment is electrically connected to the second end of the third inner rod;

a fourth plurality of secondary outer rods are electrically connected to the third upper segment at their second ends;

a fourth lower segment is electrically connected to the fourth plurality of secondary outer rods at their first ends., a fourth inner rod is electrically connected to the fourth lower segment at the inner rod's first end;

a fourth upper segment is electrically connected to the second end of the fourth inner rod;

a fifth plurality of secondary outer rods are electrically connected to the fourth upper segment at their second ends;

a fifth lower segment is electrically connected to the fifth plurality of secondary outer rods at their first ends;

a fifth inner rod is electrically connected to the fifth lower segment at the inner rod's first end;

a fifth upper segment is electrically connected to the second end of the fifth inner rod;

a sixth plurality of secondary outer rods are electrically connected to the fifth upper segment at their second end; and a sixth lower segment is electrically connected to the sixth plurality of secondary outer rods at their first end.

14. Apparatus according to claim 13, wherein:

the second inner rod is spaced from the mandrels a distance equal to or greater than the spacing between the first inner rod and the mandrels;

the third inner rod is spaced from the mandrels a distance greater than the spacing of the first inner rod from the mandrels and equal to or greater than the spacing of the second inner rod from the mandrels;

the fourth inner rod is spaced from the mandrels a distance greater than the spacing of the second inner rod from the mandrels and equal to or greater than the spacing of the third inner rod from the mandrels;

the fifth inner rod is spaced from the mandrels a distance greater than the spacing of the fourth inner rod from the mandrels; and a subsequent inner rod is spaced from the mandrels a distance greater than the spacing of every previous inner rod from the mandrels.

15. Apparatus according to claim 14, wherein:

the second upper segment is spaced from the outer conducting rods of the first electrical conductor a distance greater than the distance of the spacing of the first upper segment from the outer conducting rods of the first electrical conductor; and each subsequent upper segment is spaced from the outer conducting rods of the first electrical conductor a distance greater than the distance of the spacing of each previous upper segment from the outer conducting rods of the first electrical conductor.

16. Apparatus according to claim 15, further comprising:

cooling fluid input means associated with each core assembly to introduce cooling fluid at a predetermined rate and predetermined pressure adjacent to the core assembly; and cooling fluid output means associated with each core assembly to allow cooling fluid to exit from the region adjacent to each core assembly.

17. Apparatus according to claim 16, wherein said core assembly is made of a ferrimagnetic material chosen from the class consisting of MnZn, ZnNi, MnMg, MnMgZn, MnMgCd, MnCu and MnLi.

18. Apparatus according to claim 17, wherein said core assembly is made of a ferromagnetic material chosen from the class consisting of amorphous metallic glass, and annealed Fe, Ni, and Co., and the ferromagnetic material is in the form of a sheet less than 25 um thick wrapped around the mandrel in an alternating layer arrangement with a thin sheet of an insulator.

19. Apparatus according to claim 18, wherein said cooling fluid is drawn from the class consisting of Fluorinert and freon.

* * * * *